United States Patent [19]

Kohle et al.

[11] Patent Number: 4,544,292

[45] Date of Patent: Oct. 1, 1985

[54] MULTISTRIKE RIBBON

[75] Inventors: Ulrich Kohle, Frauenfeld, Switzerland; Hans Paffhausen, Ruthvin by Huntly, Scotland

[73] Assignee: Pelikan AG, Hanover, Fed. Rep. of Germany

[21] Appl. No.: 475,844

[22] Filed: Mar. 16, 1983

[30] Foreign Application Priority Data

Apr. 7, 1982 [CH] Switzerland ..... 2165/82

[51] Int. Cl.[4] ..... B41J 31/02

[52] U.S. Cl. ..... 400/241.2; 428/914

[58] Field of Search ..... 400/241.1, 241.2; 156/79; 427/256; 428/320.4, 321.1, 321.3, 323, 914

[56] References Cited

U.S. PATENT DOCUMENTS

| | | | |
|---|---|---|---|
| 2,984,582 | 5/1961 | Newman et al. | 428/321.3 X |
| 3,049,457 | 8/1962 | Peshin et al. | 428/914 X |
| 3,336,150 | 8/1967 | Takahashi et al. | 428/320.4 X |
| 3,348,651 | 10/1967 | Mater et al. | 400/241.2 |
| 3,392,042 | 7/1968 | Findlay et al. | 400/241.2 X |
| 3,520,495 | 7/1970 | Sotani | 242/192 |
| 3,682,683 | 8/1972 | Elbert et al. | 428/321.1 |
| 3,864,181 | 2/1975 | Wolinski et al. | 156/79 |
| 3,908,063 | 9/1975 | Rosendale et al. | 428/321.3 X |
| 4,066,585 | 1/1978 | Schepp et al. | 427/256 X |
| 4,150,187 | 4/1979 | Brown | 428/914 X |
| 4,217,388 | 8/1980 | Scott et al. | 428/321.3 |
| 4,299,504 | 11/1981 | Benz et al. | 400/208 |
| 4,321,286 | 3/1982 | Scott et al. | 428/321.3 X |
| 4,427,739 | 1/1984 | Kohle et al. | 428/323 |

FOREIGN PATENT DOCUMENTS

| | | | |
|---|---|---|---|
| 2232773 | 1/1974 | Fed. Rep. of Germany . | |
| 2418066 | 11/1975 | Fed. Rep. of Germany | 400/241.2 |
| 590784 | 8/1977 | Switzerland . | |
| 958081 | 5/1964 | United Kingdom | 400/241.1 |
| 1000682 | 8/1965 | United Kingdom | 400/241.1 |
| 1028618 | 5/1966 | United Kingdom | 400/241.1 |

OTHER PUBLICATIONS

European Patent Office Search Report relating to Application RS/65747/DE.

*Primary Examiner*—Ernest T. Wright, Jr.

*Attorney, Agent, or Firm*—Karl F. Ross; Herbert Dubno

[57] ABSTRACT

An overstrike ribbon has its color transfer layer formed with an oleaginic face which includes a polyoxyethylene fatty acid ester of polyhydric alcohol which as increased ability to backup the fatty dyestuff, and also contains a filler from the pores of which the color paste can be released with successive impacts.

3 Claims, No Drawings

MULTISTRIKE RIBBON

CROSS REFERENCE TO RELATED APPLICATIONS

The present application is related to our commonly assigned copending application Ser. No. 391,871 filed 24 June 1982, and referring in turn to Ser. No. 374,037 filed 3 May 1982, now U.S. Pat. No. 4,427,739.

FIELD OF THE INVENTION

Our present invention relates to overlapping-impact typewriter ribbons, ie. so-called multistrike ribbons, which can permit a particular portion of the struck ribbon to deliver pigment to a surface for at least a plurality of subsequent strikes, e.g. with a print wheel (daisy wheel) or other high velocity typewriting or mechanical printing mechanisms.

BACKGROUND OF THE INVENTION

While multistrike ribbons were widely used in the past and were composed of a fabric impregnated with a color transfer material and designed to run back and forth between the printing element and the platen upon which a sheet of paper or the like was supported, with the advent of word processing equipment, electrical typewriters, multicharacter printing elements, type wheels, type balls and the like, and with the desire for a high degree of reproducibility in the transferred impression, so-called disposable ribbons or film ribbons were developed.

Such ribbons, which originally could be used only once and were then discarded, were generally composed of a synthetic resin film or foil which was struck on the back by the print element, e.g. a type face or some other mechanical impact device, and had a color transfer layer on its opposite face whereby color was transferred to the receiving sheet.

In spite of the fact that such disposable ribbons were comparatively inexpensive, it nevertheless was desirable to reduce the cost still further by providing these ribbons with overstrike or multistrike capability, i.e. by permitting a region which had previously transferred color to the paper, to be reused and again transfer color so that each region of the ribbon could sustain a multiplicity of impacts. Generally speaking, in overstrike or multistrike ribbons, each region which is struck overlaps a previously struck region and is, in turn, overlapped by a subsequently struck region so that eventually each portion of the ribbon along with the characters strike the same, receives a multiplicity of impacts or strikes. Such ribbons are therefore also known as overlapping strike ribbons.

Overstrike, overlapping strike and multiuse disposable ribbons generally are advanced through an increment which is a predetermined fraction of a normal type width per impact so that it is common, for example, to incrementally advance the ribbon in steps of one third or one fifth of the normal type width so that each impact predominantly overlaps previous impact regions and only to a small extent involves a fresh region of the ribbon. By comparison with single-strike ribbons, therefore, for given lengths the ribbon must be replaced only one third to one fifth as often, and can sustain 3.3 or 5 impacts at each element of the impact area of the ribbon.

Naturally, the color transfer capability of the ribbon must be such that not all the color is transferred with the initial impact and sufficient color is retained for the subsequent impacts and further that the subsequent impacts can transfer enough material of sufficiently deep intensity and resolution.

The term "resolution" will be used herein in the same manner as "edge definition" or "edge sharpness", all of these terms meaning the ability to distinguish the transferred character from the background by an extremely sharp edge at the boundary of the character.

Overstrike ribbons also allow the complex mechanisms for ribbon reversal to be eliminated.

The aforedescribed prior applications, the art of record therein, U.S. Pat. No. 3,336,150 and U.S. Pat. No. 3,682,683 and Printed German Application No. 2,418,066 describe color transfer materials in which a transfer layer carrying the pigment is provided on a relatively thin support layer. This literature constitutes the best art currently known to us and having a bearing on this application.

Normally, overstrike ribbons consist of a thin carrier foil, to which the color-releasing layer is applied in the form of a matrix of a synthetic resin binder and a color paste dispersed therein. The color paste generally includes an oleaginous substance which does not interact with the support and may be referred to hereinafter as a pigment or color-displacing oil and the pigment which can be soluble or otherwise homogeneously distributed in the oil.

To produce this color transfer coating, a solution of the binder in a solvent, which is also a solvent for the oil, is applied to the carrier foil and the solvent phase eliminated by drying, i.e. the solvent is evaporated. This distributes the oil in numerous microdroplets which ideally intercommunicate with one another, within the hardened matrix formed by the resin or binder.

The color transfer coating is thus effectively a foam or sponge layer from which, at each impact or strike, a portion of the coloring material and oil is caused to extrude from the pores onto the paper and, especially where the pores intercommunicate, the thus discharged pores can refill from adjoining regions with the oil-pigment mixture.

An important desideratum for such overstrike ribbons is that with each impact, the quantity of pigment per unit area which is expressed from the color transfer layer should be the same for all regions and all subsequent impacts within the number of overstrikes for which the ribbon is designed.

This guarantees that the color intensity will not diminish from impact to impact, i.e. between the first strike and the last overstrike, that the image transfer at each stroke will be uniform over the entire character and free from more dense and less dense regions, and that the entire typescript will be uniform.

The oleaginous material which was used in the past was generally castor oil, neat's-foot oil, peanut oil, glycerine triolein or corresponding natural or synthetic oils. These substances were found to suffice with overstrike ribbons allowing five overlapping impacts.

To reduce the ribbon cost still further, yet greater overstrike capabilities are desirable and hence it is desirable to step the ribbon by substantially less than one fifth of the width of the type face. Conventional ribbons could not be utilized effectively for larger numbers of strikes without developing a mottled imprint most noticeable when the print involves underscoring.

In practice, therefore, when attempts were made with the prior art systems to utilize six or more strikes per region of the overstrike band, significant color fading was observed with the sixth strike and it was difficult to ensure for the sixth strike a sufficient supply of color.

It was proposed, in this connection, to increase the thickness of the band by increasing the thickness of the color transfer, thereby intending to provide additional coloring matter. This approach had little value because the increased thickness of the color transfer layer resulted in a decrease in the length of the ribbon for a standard spool and an ultimate reduction in the number of impressions which could be obtained from a given ribbon.

Even more significantly, when the color transfer layer becomes unduly thick, the color transfer therefrom from one strike to the next does not remain constant and hence the typescript is a mottled product.

Attempts have also been made to increase the proportions of the coloring paste in the color transfer coating. This has not been found to be practical since the formation of an effective sponge layer requires a certain minimum ratio of color paste to binder which must be maintained.

Finally, it may be noted that even efforts to increase the coloring power of the color paste did not work effectively. When, for instance, the coloring power was increased by raising the pigment concentration, the paste lost its flowability.

Efforts were also made to provide the color in the oil phase utilizing hydrophobic oil-soluble dyestuffs. This did not lead to effective results since even the hydrophobic or oleophilic dyestuffs were soluble in the earlier oleagenic substances only to limited degrees without sufficient increase in the coloring depth.

OBJECTS OF THE INVENTION

It is the principal object of the present invention to provide an overstrike ribbon, particularly suitable for use with print wheel typewriters and printers operating with high impact velocity, which can provide an overstrike capability of greater than ten times and yet for all of the impressions will provide uniform, deep black edge-sharp (high-resolution) impressions.

Another object of this invention is to provide an improved overstrike ribbon which can be used for a far greater number of impressions and can be advanced at a small fraction of the stepping increment of earlier ribbons.

Still another object of the invention is to improve upon the teaching of the above mentioned copending applications.

SUMMARY OF THE INVENTION

These objects and others which will become apparent hereinafter are attained, in accordance with the present invention, in a typewriter ribbon having a film or foil synthetic resin support on one surface of which a color transfer layer is provided wherein the color transfer layer includes a coloring agent on an oleaginic material in which the coloring agent is dispersed as well as a binder and wherein the oleaginic substance or oil phase of the coloring paste includes a polyethoxylated fatty acid ester of a polyhydric alcohol and contains a finely divided filler with a high specific surface area and a particle size distribution of 0.2 to 20 microns in addition to the solubilized oleophilic dyestuff.

The starting point of the present invention is the completely surprising discovery that a polyethoxylated (Polyoxyethyl) fatty acid ester of a polyvalent alcohol, i.e. a polyhydric alcohol, has an extraordinarily high capability for solubilizing (receiving) fatty dyestuffs and its ability to solubilize such dyestuffs increases with increasing numbers of ethoxy groups per molecule.

While, as a practical upper limit, the fatty dyestuffs were soluble in the process used in overstrike ribbons up to now to a maximum of 1% and generally the concentration of the dyestuffs in the oil was substantially less than that, polyethoxylated oils can take up to 50% fatty dyestuffs in soluble form, e.g. the concentration of the fatty dyestuffs in oil can be increased by orders of magnitude over those which have been obtainable heretofore. Since hitherto unrealizable, coloring agent concentrations can obtain in the color transfer layer, the color intensity with even a large number of overstrikes remains high.

Another surprising advantage of the invention, which is totally unexpected, is that the polyethoxylated fatty acid esters of polyhydric alcohols do not cause deterioration of the binder of the color transfer layer and hence permit formation of the sponge layer. This was unexpected in itself because normally the incorporation of ethoxy or oxyethylene groups in the molecule would be expected to increase the reactivity of the oils with synthetic resin binders to the point that a spongy layer would not be expected to form.

In particular, we have found that, for the purposes of the present invention, the fatty acid ester should be an ester of a fatty acid having 12 to 25 carbon atoms, formed with alcohols having 3 to 6 hydroxyl groups and further that the molecular structure should include 20 to 60 ethoxy groups per molecule. Typical of compositions which can be used in accordance with the invention and the preferred compositions are polyoxyethylene(40)sorbitepentaoleate, the corresponding hexaoleate, the corresponding heptaoleate, and the corresponding octaoleate, polyoxyethyleneglycerine triricinolate or trioleate and corresponding compounds of other fatty acids having an average of about 40 ethoxy groups per molecule.

As a consequence of the higher solubilization capacity of the polyethoxylated fatty acid for fatty coloring agents, it is not desirable that all of the oil base of the coloring coating derive from such fatty acid esters. In fact, fatty acid esters may be mixed in an amount up to 50% with the oils hitherto utilized, including those mentioned and mineral oils, for overstrike ribbons without dropping the concentration of coloring matter in the coloring paste too low.

The fatty coloring agents which can be used are all of the oleophilic dyestuffs, especially Sudan deep black, or fatty black HB; naturally other colors or even fluorescent coloring agents can be utilized.

As noted, apart from the oleophilic dyestuff and fatty acid ester, the color transfer layer also contains an inclusion of finely divided fillers, especially diatomaceous earth, active carbon or broken microspheres with a large accessible inner surface. The microspheres can be synthetic resin microspheres (see U.S. Pat. Nos. 3,615,974 and 3,864,181) which have been broken, e.g. by partial crushing.

These fillers provide pores in which a portion of the color paste, generally most of the color paste, is relatively firmly held so that with the initial impacts or strikes only a limited proportion of the color paste is transferred at each strike as is necessary for clear typewritten imprints.

Simultaneously with the pressing of free color paste from the spongy synthetic resin matrix, additional color paste is released by the partial destruction of the solid filler so that a portion of the color paste previously trapped in the pores of the filler is liberated to constitute a further supply of the color paste for subsequent impacts and strikeovers. The process repeats with each impact and, in practice, has been found to yield a color transfer product capable of a large number of overstrikes.

The filler has the additional advantage that most of the oleaginic material is trapped in the pores of the filler so that only a limited amount of free oil remains in the spongy layer and thus only a small amount of this oil is available for interaction with the carrier foil. Detrimental effects upon the carrier foil are avoided and it is no longer necessary even to provide adhesion-promoting layers between the color-transfer layer and the carrier foil as were hitherto necessary when there was a possibility of such interaction with release or loosening of the color transfer layer.

We have found it to be advantageous, moreover, to include in the color transfer layer one or more cationic wetting agents. This additive appears to prevent excessive adhesion of the normally acidic pigment particles to the inner surfaces of the sponge and to mobilize these particles, i.e. improve their mobility. Preferably, the wetting agent is a fatty amine salt, i.e. a salt of a long-chain natural or synthetic fatty acid alkyl amine or diamine formed with long-chain or short-chain fatty acids.

The invention thus provides a color release layer adapted to contain the coloring pigment in an extremely high concentration and thus having a high coloring power, albeit in a very thin layer. The coloring paste is released over a large number of impacts with substantially constant intensity and with high differential resolution so that variations in intensity are not noticeable in spite of the fact that 12 or more overstrikes can be provided.

It is possible with the ribbon according to the invention to more than double the useful life of a ribbon of a given length by comparison with even the best ribbons hitherto fabricated.

We have found that best results are obtained with the components used to make the ribbon in the following weight proportions:

| | |
|---|---|
| Polyethoxylated fatty acid ester with up to 60 ethoxy groups per molecule | 12 to 20 parts |
| Fatty dyestuff (30 to 60% by weight solution in a polyethoxylated fatty acid ester with up to 60 ethoxy groups per molecule) | 6 to 12 parts |
| Cationic wetting agent | 1.5 to 4 parts |
| Carbon black and/or other coloring pigments | 6 to 15 parts |
| Solvent | 45 to 90 parts |
| Binder | 8 to 12 parts |
| Porous filler | 6 to 12 parts |

The formation of the color transfer coating, the nature of the film or foil support, the solvents used, the binders used, to the extent not otherwise set forth herein, may be as described in the aforementioned copending applications.

The polyethoxylated fatty acid ester may be partly replaced by oils utilized heretofore, such as castor oil, glycerinetriolein or mineral oil.

The preferred binders for the system of the invention include those customarily used for color transfer layers in typewriter and printer ribbons, especially polyacrylates, polyvinyl chloride/polyvinyl acetate copolymers, linear polyesters, polyvinylacetates and polystyrenes, and polyamides.

The most preferred solvents are those which have been utilized effectively heretofore in the fabrication of ribbons, namely, methylethylketone, toluene and isopropyl alcohol or mixtures thereof. Preferably, the solvent is supplied as the solvent for the binder which is added to the system in a 25% solution.

Once the mixture is formed, it is coated onto the foil by conventional means and dried to evaporate the solvent.

In the examples given below, the components as applied to the foil are described and the proportion in the finished product can be readily calculated.

The carrier foils may be any of those which have been used heretofore as printing machine typewriter ribbon, especially polyester, polyethylene, polypropylene or polyamide foils. The total thickness of the finished ribbon should not exceed 26 microns and the carrier foil should be held as thin as possible, preferably to have a thickness of about 8 microns.

Occasionally it is found to be advantageous to provide an antistatic coating in thickness of about 2 microns between the foil and the color transfer layer.

SPECIFIC EXAMPLES

In the following examples, the abbreviation "PSSO" has been used to designate polyoxyethylene-sorbite-heptaoleate, with an average of 40 ethoxy groups per molecule. All parts are given by weight unless otherwise indicated.

EXAMPLE 1

| | |
|---|---|
| PSSO | 18.1 |
| Fatty black, 30% in PSSO | 9.6 |
| Tallow propylene diamineoleate | 2.3 |
| Blue pigment (Reflex blue R.C.I. 42765-1) | 2.1 |
| Carbon Black | 7.0 |
| Polyvinylchloride/Polyacrylonitrile copolymer (PVC/AC) 25% in methylethylketone | 45.3 |
| Diatomaceous earth | 8.8 |
| Methylethylketone | 15.0 |
| Toluene | 21.6 |

EXAMPLE 2

| | |
|---|---|
| Glycerintrioleate | 14.1 |
| Fatty black (30% in PSSO) | 10.0 |
| Tallow propylene diamineoleate | 2.3 |
| Blue pigment (Reflex blue R.C.I. 42765-1) | 2.1 |
| Carbon Black | 7.0 |
| PVC/AC 25% in methylethylketone | 45.3 |
| Diatomaceous earth | 8.8 |
| Toluene | 21.6 |
| Methylethylketone | 15.0 |

EXAMPLE 3

| | |
|---|---|
| Sorbite Dioleate | 18.1 |
| Sudan deep black, 30% in PSSO | 10.0 |
| Coconut oil aminoleate | 3.2 |
| Blue pigment (Reflex blue R.C.I. 42765-1) | 2.1 |
| Carbon Black | 7.0 |
| PVC/AC 25% in methylethylketone | 45.3 |
| Diatomaceous earth | 8.8 |
| Toluene | 21.6 |
| Methylethylketone | 15.0 |

EXAMPLE 4

| | |
|---|---|
| PSSO | 14.1 |
| Glycerintrioleate | 4.0 |
| Sudan deep black, 30% in PSSO | 10.0 |
| Stearylaminacetate | 3.7 |
| Blue pigment (Reflex blue R.C.I. 42765-1) | 2.5 |
| Carbon Black | 7.0 |
| PVC/AC 25% in methylethylketone | 45.3 |
| Diatomaceous earth | 8.8 |
| Toluene | 21.6 |
| Methylethylketone | 15.0 |

In each case, the composition was applied to a plastic foil having a thickness of 8 microns to leave, after evaporation of the solvent, a color transfer layer having a thickness of 16 microns. Each of the ribbons thus produced was found to be effective with a 12-overstrike type wheel to provide uniform and edge-sharp imprints at high velocity and high energy.

We claim:

1. In an overstrike ribbon having enhanced strikeover capacity and comprising a polyester, polyethylene, polypropylene or polyamide carrier foil provided with a color transfer layer wherein the color transfer layer comprises a binder matrix of a synthetic resin in which a coloring paste is disposed for limited transfer to a print-receiving surface, the improvement wherein said coloring paste comprises at least one polyethoxylated fatty acid ester of a polyhydric alcohol forming an oleaginic phase in which a coloring agent in the form of an oleophilic dyestuff is dissolved, said polyethoxylated fatty acid ester being selected from the group which consists of polyoxyethylene-(40)-sorbite pentaoleate hexaoleate, heptaoleate and octaoleate and further contains a finely divided solid filler having a high internal surface area and a particle size distribution of 0.2 to 20 microns so that twelve and more strikeovers can be effected with high definition transfer, said filler being selected from the group which consists of diatomaceous earth, precipitated silica, active carbon and/or broken microspheres.

2. The improvement defined in claim 1 wherein the polyoxyethylene fatty acid ester is cut with up to 50% with a natural or synthetic oil.

3. The improvement defined in claim 1 wherein said color transfer layer further includes a cationic wetting agent.

* * * * *